US005189478A

United States Patent [19]

Hara et al.

[11] Patent Number: 5,189,478

[45] Date of Patent: Feb. 23, 1993

[54] IMAGE FORMING METHOD AND IMAGE FORMING APPARATUS, INCLUDING MEANS FOR CONTROLLING THE CHARGE ON A TRANSFER MEDIUM

[75] Inventors: Yoshinobu Hara, Shinshiro; Shizuo Yuge, Toyokawa; Kazuyoshi Hara, Atsugi, all of Japan

[73] Assignee: Minolta Camera Kabushiki Kaisha, Osaka, Japan

[21] Appl. No.: 765,390

[22] Filed: Sep. 25, 1991

[30] Foreign Application Priority Data

Sep. 29, 1990 [JP] Japan ..... 2-261140
Sep. 29, 1990 [JP] Japan ..... 2-261141

[51] Int. Cl.[5] ..... G03G 15/01; G03G 15/04

[52] U.S. Cl. ..... 355/271; 355/327; 430/33; 430/42

[58] Field of Search ..... 355/326, 327, 271, 274, 355/221, 222; 430/31, 33, 42, 126

[56] References Cited

U.S. PATENT DOCUMENTS 4,984,026 1/1991 Nishise et al. ..... 355/277
5,041,878 8/1991 Takai et al. ..... 355/273

FOREIGN PATENT DOCUMENTS 62-36220 8/1987 Japan .

*Primary Examiner*—Richard L. Moses
*Attorney, Agent, or Firm*—Burns, Doane, Swecker & Mathis

[57] ABSTRACT

An image forming apparatus wherein toner images formed on a photosensitive member are transferred to a transfer medium and overlaid thereon, and the toner images on the transfer medium are transferred onto a copy sheet. The apparatus has a charger for reducing charge on the toner images transferred to the transfer medium, and output of the charger is controlled in accordance with the number of toner images on the transfer medium. Alternatively, the image forming apparatus has a first charger for reducing charge on the toner images transferred to the transfer medium and a second charger for recharging the toner images processed by the first charger.

13 Claims, 14 Drawing Sheets

FIG. 5 COMPARATIVE CASE

FIG. 6 FIRST EMBODIMENT

FIG. 8 SECOND EMBODIMENT

FIG. 9 COMPARATIVE CASE

FIG. 12 COMPARATIVE CASE
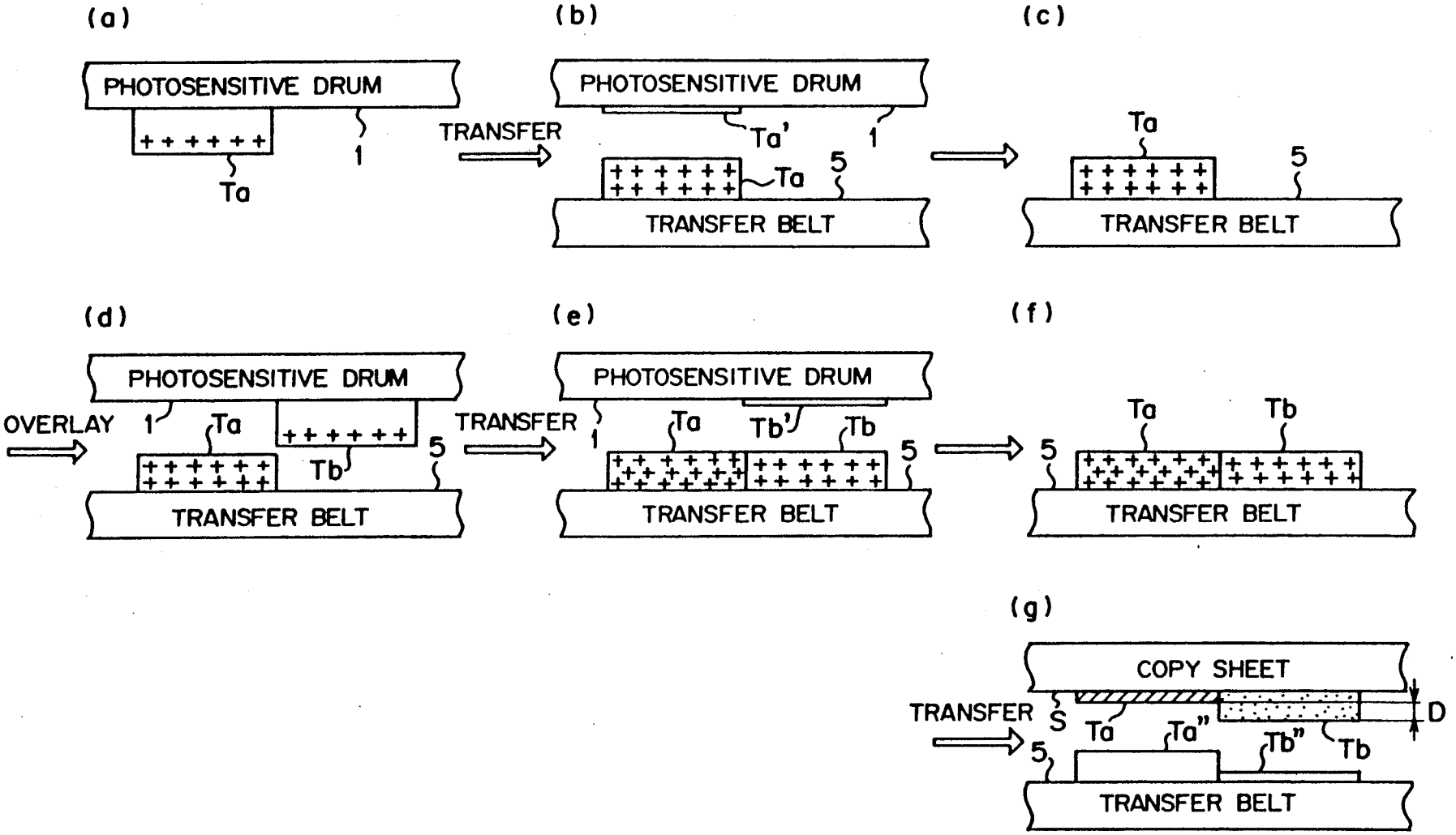

FIG. 13 COMPARATIVE CASE
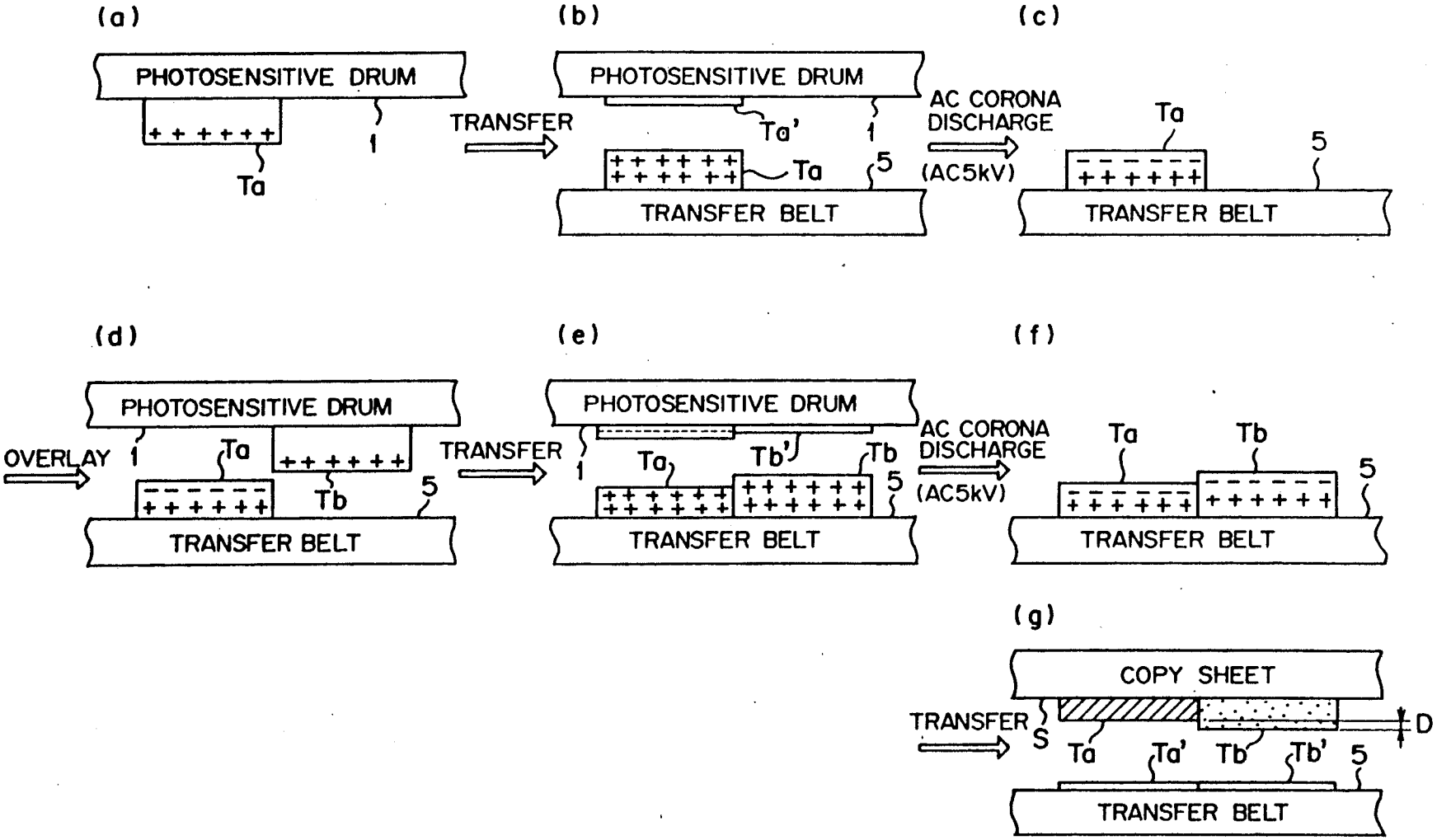

FIG. 14 THIRD EMBODIMENT.
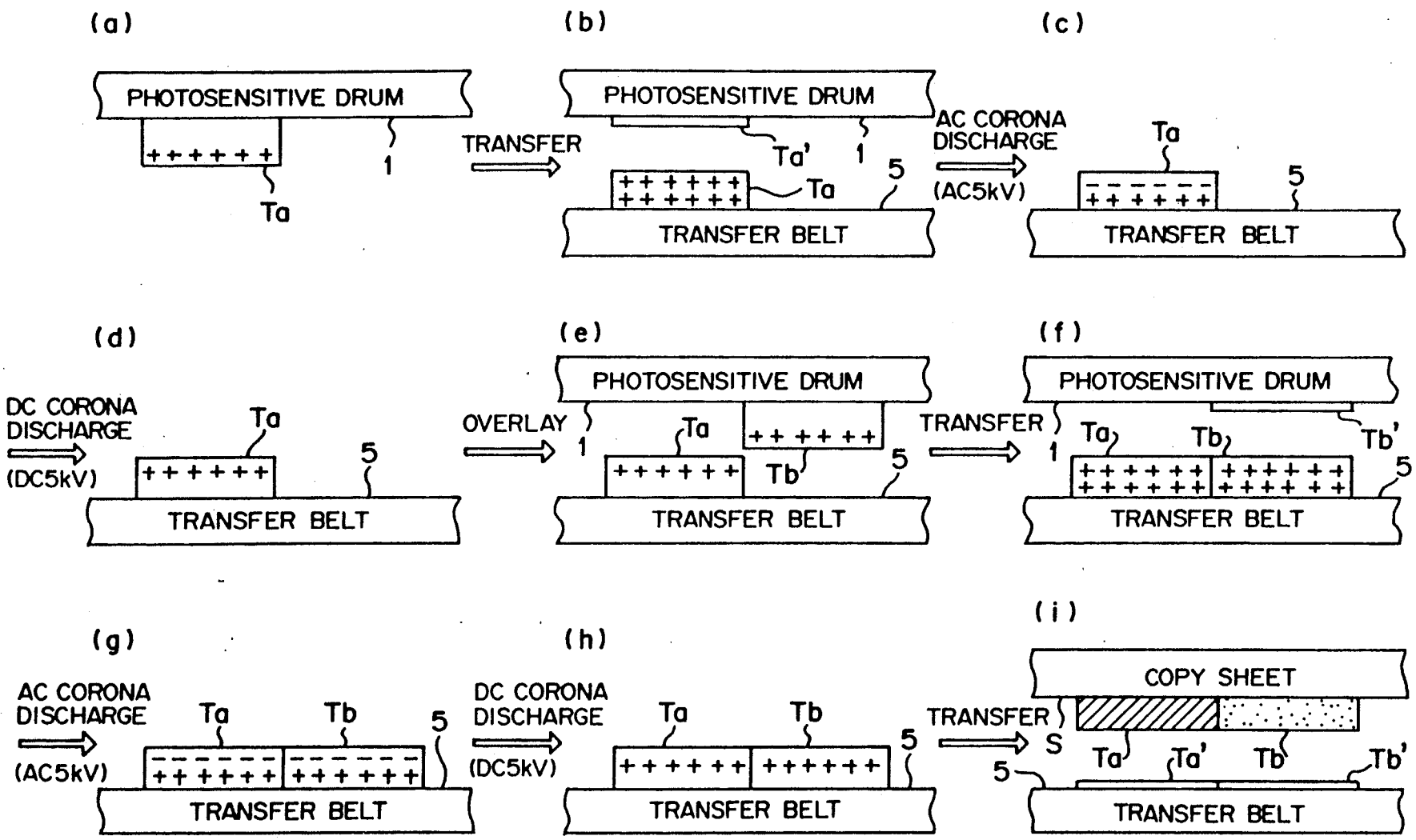

IMAGE FORMING METHOD AND IMAGE FORMING APPARATUS, INCLUDING MEANS FOR CONTROLLING THE CHARGE ON A TRANSFER MEDIUM

BACKGROUND OF THE INVENTION

1. Field of the Invention

The present invention relates to an image forming method and an image forming apparatus, and more particularly to a toner image transfer type electrophotographic image forming method and an apparatus adopting the method.

2. Description of Related Art

In the art of electrophotography, a method of reproducing a full color image having the following processes is well-known. First, an original full color image is color-separated into images of three primary colors. Next, an electrostatic latent image corresponding to each of the three Primary color images is formed on a photosensitive member (electrostatic latent image carrying member), and the latent image is developed into a toner image thereon. Then, the toner image is transferred to a transfer medium (first transfer). The processes from the electrostatic latent image formation through the first image transfer are repeated until all the three primary color images are overlaid on the transfer medium. Thereafter the overlaid toner images are transferred to a copy sheet (second transfer). However, in a conventional full color copying apparatus adopting this method, charge applied to a toner image for the first transfer of the toner image is left thereon, and this negatively influences the first transfer of a next toner image.

In the light of this problem, Japanese Patent Laid Open Publication No. 62-36220 proposes that charge on a toner image is reduced immediately after the transfer of the toner image to the transfer medium.

The toner image charge erasure is effective on the first image transfer. However, problems caused by poor second image transfer, such as density unevenness and white spots appearing on the reproduced image on the copy sheet, and problems caused by reversion of toner from the transfer medium to the photosensitive member during the first transfer of successive toner images, such as an increase of the amount of residual toner and color imbalance of the copy image, are left unsolved. In this specification, density unevenness and white spots appearing on a copy image are referred to as image noise.

SUMMARY OF THE INVENTION

An object of the present invention is to provide an image forming method and an image forming apparatus wherein copy images of high quality can be obtained.

Another object of the present invention is to provide an image forming apparatus for forming copy images free from image noise such as density unevenness and white spots.

A further object of the present invention is to provide an image forming apparatus for forming copy images which have good color balance, while producing little residual toner.

In order to attain the objects above, an image forming apparatus according to the present invention comprises means for reducing charge on a toner image transferred to a transfer medium by first transfer means, the charge reducing means being disposed between the first transfer means and second transfer means, and the charge reducing means is operated in one of the following manners.

An essential point of a first manner of operating the charge reducing means is heightening output of the charge reducing means gradually as the number of toner images on the transfer medium is increasing. This results in effective reduction of charge on the toner images, especially on toner overlapping parts. Another essential point of the first manner is lowering the output of the charge reducing means to a value smaller than the starting output value immediately before the second transfer. This prevents too much reduction of toner charge. Thus the toner images on the transfer medium can be transferred to a sheet evenly with fine transfer efficiency.

Essential points of a second manner are keeping output of the charge reducing means a specified value during the first transfer of the toner images and stopping the operation of the charge reducing means immediately before the second transfer. This operating manner does not cause too much toner charge reduction. Consequently the toner images on the transfer medium are transferred to a sheet efficiently.

An image forming apparatus according to the present invention comprises not only the charge reducing means disposed between the first transfer means and the second transfer means but also recharging means disposed between the charge reducing means and the second transfer means. The recharging means is to apply DC corona discharge to a toner image which has been processed by the charge reducing means, the DC corona discharge having the same polarity as the toner.

A toner image formed on the electrostatic latent image carrying member is transferred to the transfer medium by corona discharge from the first transfer means, the corona discharge having polarity opposite to that of the toner. The toner image transferred to the transfer medium is subjected to AC corona discharge from the charge reducing means. The toner image gains charge a little during the first transfer, but the AC corona discharge reduces the charge on the toner image to the amount the toner image had before the first transfer, and also causes part of the toner image (especially superficial part) reversely charged. The tone image is further subjected to the DC corona discharge having the same polarity as the toner, which removes the reverse charge on the toner image.

In a color copy mode, the process above is repeated several times, and toner images of different colors overlaid on the transfer medium are transferred to a sheet by corona discharge from the second transfer means, the corona discharge having polarity opposite to that of the toner.

BRIEF DESCRIPTION OF THE DRAWINGS

These and other objects and features of the present invention will become apparent from the following description taken in conjunction with the preferred embodiments thereof with reference to the accompanying drawings, in which;

FIG. 12 is an explanatory view showing changes of charge on toner during a transferring process in a comparative case;

FIG. 13 is an explanatory view showing changes of charge on toner during a transferring process in another comparative case; and FIG. 14 is an explanatory view showing changes of charge on toner during a transferring process according to the third embodiment.

DETAILED DESCRIPTION OF THE PREFERRED EMBODIMENTS

Figure 1:
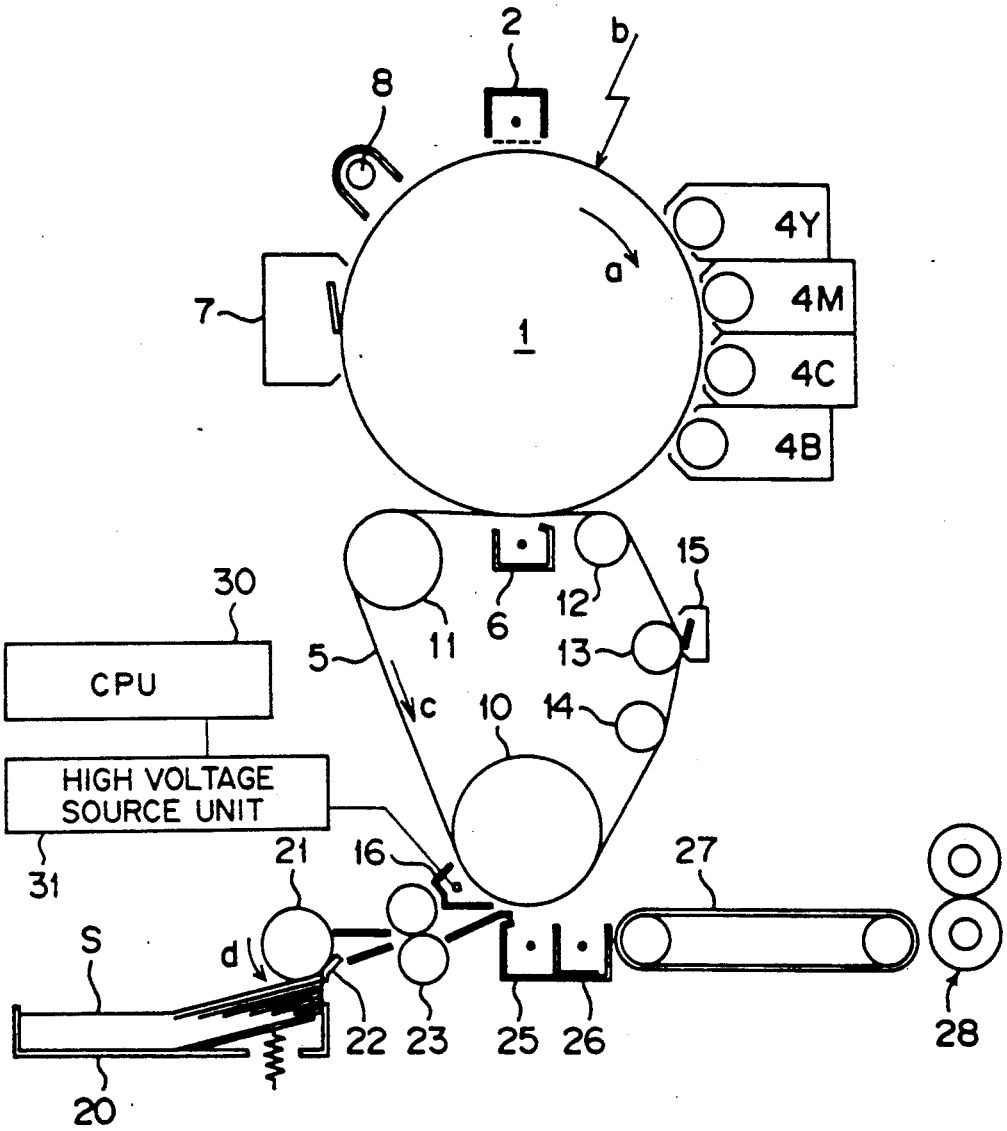
FIG. 1 is a schematic elevational view of an image forming apparatus of a first embodiment according to the present invention.

The description of preferred embodiments according to the present invention is given below, referring to the drawings.

First Embodiment: FIGS. 1-6

FIG. 1 shows a full color copying apparatus of a first embodiment according to the present invention. An electric charger 2, developing devices 4Y, 4M, 4C and 4B, an intermediate transfer belt 5, a residual toner cleaning device 7, a residual charge erasing lamp 8 are installed around a photosensitive drum 1 which rotates in the direction of an arrow a. The photosensitive drum 1 is exposed to a light from the direction of an arrow b through an optical system (not shown), and an electrostatic latent image corresponding to an image of an original which is set on an original supporting glass (not shown) is formed thereon. The developing device 4Y contains a developer including a yellow toner, the developing device 4M contains a developer including a magenta toner, the developing device 4C contains a developer including a cyan toner, and the developing device 4B contains a developer including a black toner. Each developing device is operated selectively.

The intermediate transfer belt 5 which is set on rollers 10, 11, 12, 13 and 14 endlessly rotates in the direction of an arrow c leaded by a rotation of a driving roller 11 at the same speed of the photosensitive drum 1. The transfer belt 5 is made of polyurethane rubber or EPDM (terpolymer ternary polymerized of ethylene, propylene and dien) of which volume resistivity is about $1\times10^{10}$-$1\times10^{13}\Omega$cm, and formed in belt-shape of which thickness is approximately 600 μm. A surface of the transfer belt 5 is covered by 10-30μm thick fluorine-contained water paint of which volume resistivity is about $1\times10^{9}$-$1\times10^{12}\Omega$cm to obtain smoothness and a toner separating characteristic.

The roller 10 functions as a counter electrode for second transfer explained below. Inside the ring of the intermediate transfer belt 5, a first transfer charger 6 is set in the opposite position of the photosensitive drum 1. Also, around the intermediate transfer belt 5, a second transfer charger 25 and an AC separation charger 26 are set in the opposite side of the electrode roller 10, and a residual toner cleaning device 15 is set removably in the opposite side of the back up roller 13.

Further, an AC charger 16 is disposed in an upstream side of the second transfer charger 25, and the AC charger 16 faces the intermediate transfer belt 5. A high voltage source unit 31, which impresses a high voltage on a charging wire of the AC charger 16, can output various voltages. A CPU 30 controls turning on and off, and changing the output of the high voltage source unit 31. The AC charger 16 applies AC corona discharge to a toner image on the intermediate transfer belt 5 so as to reduce the charge on the toner image to an appropriate value. The operation of the AC charger 16 will be described later in more detail, suggesting practical output values.

Copy sheets S which are contained in an automatic sheet feeding cassette 20, which is removable from the copying apparatus, are fed one by one to the second transfer section by a rotation of the sheet feeding roller 21 in the direction of an arrow d and a separation plate 22 which contacts with the sheet feeding roller 21 with slight pressure. Also a sensor to detect the size of the copy sheets S contained in the cassette (the sensor is of a well-known type) is set in the sheet feeding section. A copy sheet passage is composed of various guide plates, a pair of timing rollers 23, a conveyer belt 27, and a fixing device 28.

In the above composition, in a mono color copy mode, negative polarity charge is applied uniformly to a surface of the photosensitive drum 1 by the electric charger 2, and then the surface of the photosensitive drum 1 is exposed to the light from the optical system (not shown) to form an electrostatic latent image according to an original image thereon. This electrostatic latent image is developed by a positively charged toner of a preselected developing device among the developing devices 4Y, 4M, 4C and 4B. Then the toner image is transferred onto the intermediate transfer belt 5 in an electric field which is formed by the negative electric charge generated from the first transfer charger 6. The toner image transferred onto the intermediate transfer belt 5 is subjected to the AC corona discharge from the AC charger 16. The voltage impressed on the AC charger 16 by the high voltage source unit 31 at that time is a predetermined value V0. The value V0 is appropriate for reducing the toner charge by an amount increased during the first transfer of the toner image. Thus the charge on the toner image is adjusted by the AC corona discharge. Then, the toner image is transferred onto a copy sheet S in an electric field which is formed by the negative electric charge generated from the second transfer charger 25. After the second transfer, the charge on the copy sheet S is removed therefrom in an AC electric field which is formed by the AC separation charger 26, and released from the intermediate transfer belt 5. Then the toner thereon is fixed by heat in the fixing device 28 and ejected to a tray (not shown).

In a full color copy mode, an original image is color-separated into a yellow image, a magenta image, a cyan image and a black image. The images are each formed on the photosensitive drum 1 as electrostatic latent images, and developed by the respective developing devices 4Y, 4M, 4C and 4B. Then the toner images are transferred one by one to the intermediate transfer belt 5 and are overlaid thereon. In this process, each of the toner images transferred to the intermediate transfer belt 5 is subjected to the AC corona discharge from the AC charger 16 when passing the charger 16, and thus the charge on the toner images is adjusted. More specifically, first the AC charger 16 impressed with a voltage V1 (V1>V0) applies AC corona discharge to the yellow (Y) toner image transferred to the intermediate transfer belt 5 in order to reduce the charge on the yellow toner image. Next, the magenta (M) toner image is transferred to the intermediate transfer belt 5 to be overlaid on the Yellow toner image, and the AC charger 16 is impressed with a voltage V2 (V2>V1). Then, the cyan (C) toner image is transferred to the intermediate transfer belt 5 to be overlaid on the yellow and the magenta toner images, and the AC charger 16 is impressed with a voltage V3 (V3>V2). Further, the black (B) toner image is transferred to the intermediate transfer belt 5 to be overlaid on the yellow, the magenta and the cyan toner images, and the AC charger 16 is impressed with the voltage V0.

Because the intermediate transfer belt 5 is largely influenced by the environments such as humidity, it is preferred that the voltage values V0, Vl, V2 and V3 are controlled in a feedback system using values of an electric current flowing in the electrode roller 10. With the feedback system, changes of the toner charge on the intermediate transfer belt 5 caused by changes of the environments as well as caused by changes of the output of the AC charger 16 can be detected. In this first embodiment, specifically, the AC charger 16 is impressed with voltages so that a current of ±30 μA, a current of ±35 μA, a current of ±40 μA and a current of ±5 μA will flow in the electrode roller 10 after the first transfer of the Y toner image, the M toner image, the C toner image and the B toner image respectively.

Incidentally, while the color toner images are transferred to the intermediate transfer belt 5 to be overlaid thereon, the copy sheet S is not fed, and the second transfer charger 25 and the separation charger 26 are off. The cleaning device 15 which is set away from the intermediate transfer belt 5 also stops cleaning operation. After the four kinds of toner images are overlaid on the intermediate transfer belt 5, a copy sheet S is fed, and the second transfer charger 25 and the separation charger 26 are turned on, and then the full color toner image is transferred onto the copy sheet S.

Figure 2:
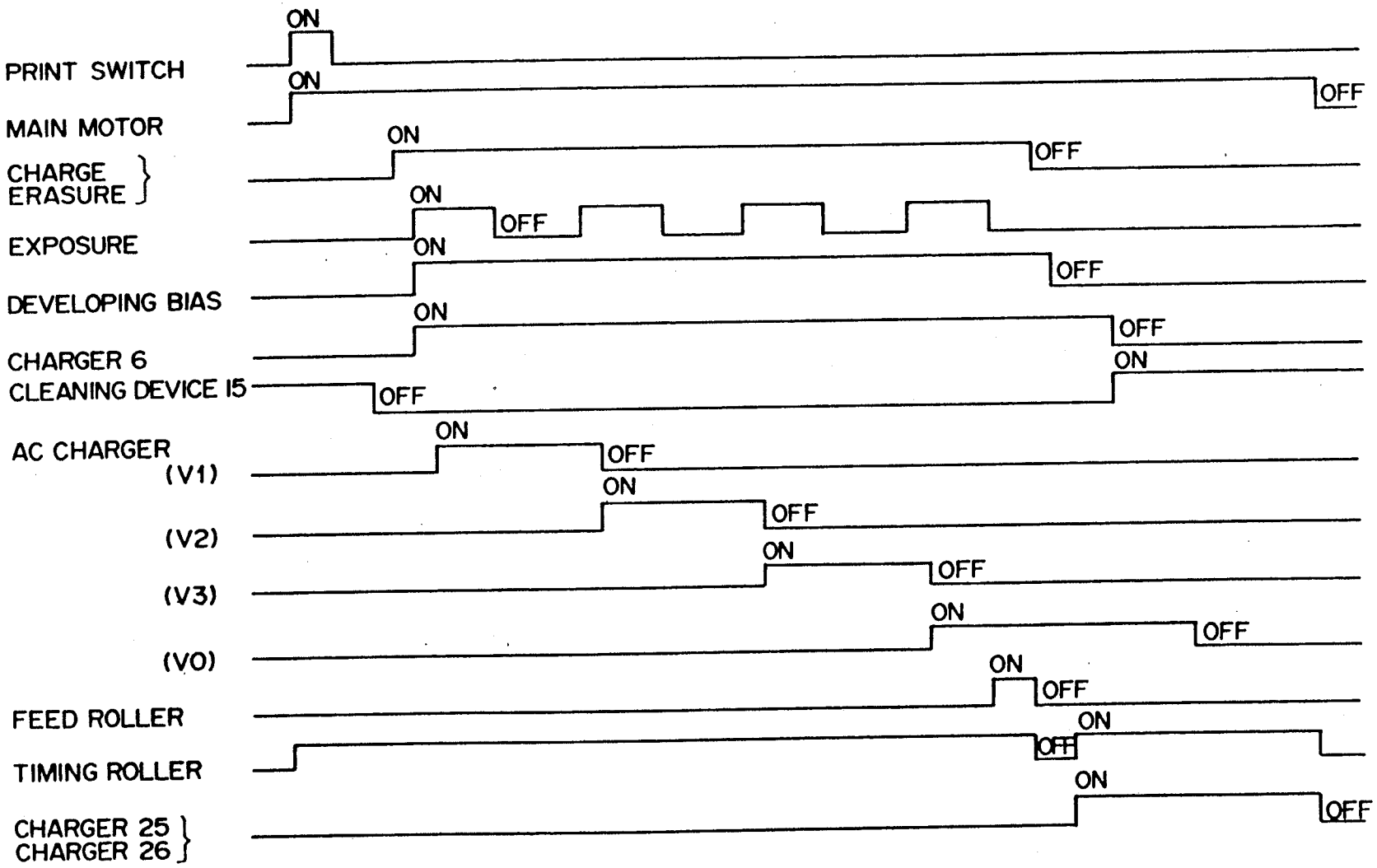
FIG. 2 is a time chart showing timing of operating each element of the image forming apparatus.

FIG. 2 is a time chart showing timing of operating the components of the image forming apparatus to realize the above-described control.

Figure 3:
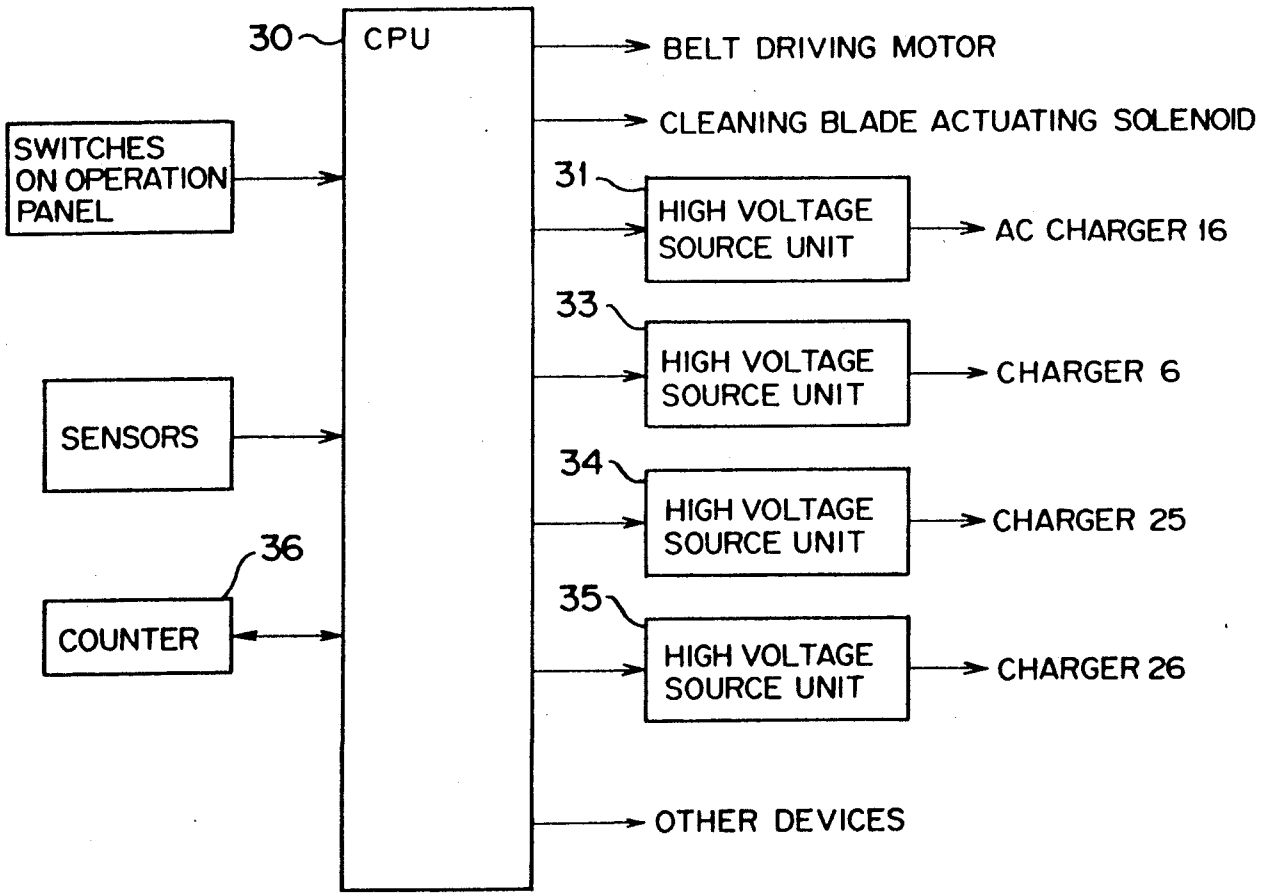
FIG. 3 is a block diagram showing a control circuitry of the image forming apparatus.

FIG. 3 shows a control circuitry of the apparatus. The main element of the control circuitry is a CPU 30. Signals from various switches on an operation panel and from sheet sensors provided in the sheet passage are inputted into the CPU 30, and signals are outputted from the CPU 30 to the high voltage source unit 31 of the AC charger 16, an intermediate transfer belt driving motor, a solenoid provided in the cleaning device 15 to press the blade, and the high voltage source units 33, 34 and 35 of the chargers 6, 25 and 26.

The CPU 30 also contains a counter 36, and the counter 36 counts rotations of the intermediate transfer belt 5 for the first transfer of toner images during one cycle of operation in the full color copy mode.

In the first embodiment, the output control of the AC charger 16 can be carried out as follows with the control circuitry. Every time a toner image is laid on the intermediate transfer belt 5, the output of the AC charger 16 is heightened, and after transferring the last toner image to the intermediate transfer belt 5 and before starting the second transfer, the output of the AC charger 16 is lowered to a value smaller than the starting value. The toner charge on the intermediate transfer belt 5 which was raised by effect of the electric field formed by the first transfer charger 6 is lowered appropriately in this manner, which results in improving quality of the second transfer and preventing image noise from appearing on the copy image.

Figure 4:
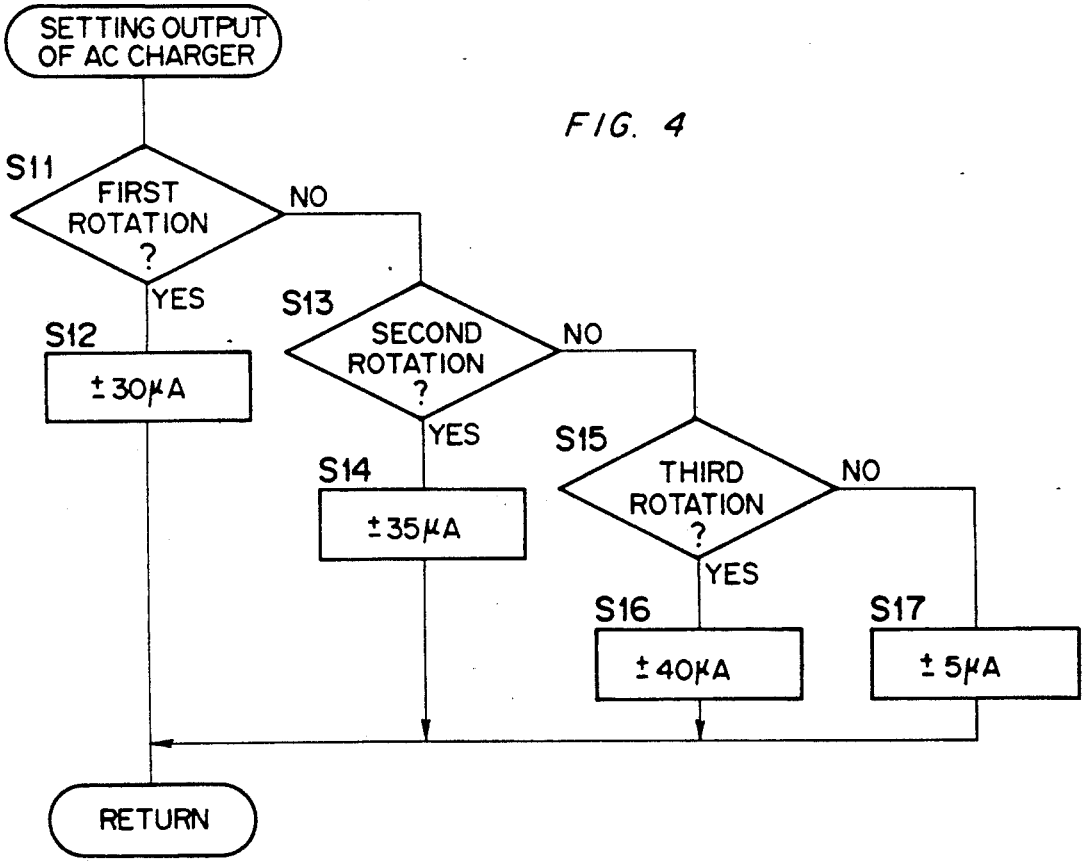
FIG. 4 is a flowchart showing a control procedure of the image forming apparatus of the first embodiment.

The output of the AC charger 16 is controlled following a procedure represented by the flowchart of FIG. 4. The number of rotations of the intermediate transfer belt 5 is detected by the counter 36 at steps S11, S13 and S15, and the output of the AC charger 16 is set at step S12, S14 or S15 according to the number of rotations. More specifically, when it is judged at step S11 that the intermediate transfer belt 5 has started a first rotation, the output of the AC charger 16 is set at step S12 so as to cause an electric current of ±30 μA to flow in the electrode roller 10. When it is judged at step S13 that the belt 5 has started a second rotation, the output of the AC charger 16 is set at step S14 so as to cause an electric current of ±35 μA to flow in the electrode roller 10. When it is judged at step S15 that the belt 5 has started a third rotation, the AC charger 16 is set at step S16 so as to cause an electric current of ±40 μA to flow in the electrode roller 10. When the judgment at step S16 is "NO", which means that the belt 5 has started a fourth rotation, the output of the AC charger is set at step S17 so as to cause an electric current of ±5 μA to flow in the electrode roller 10.

Adjustment of the toner charge achieved by the AC corona discharge from the AC charger 16 is hereinafter described in detail.

Figure 5:
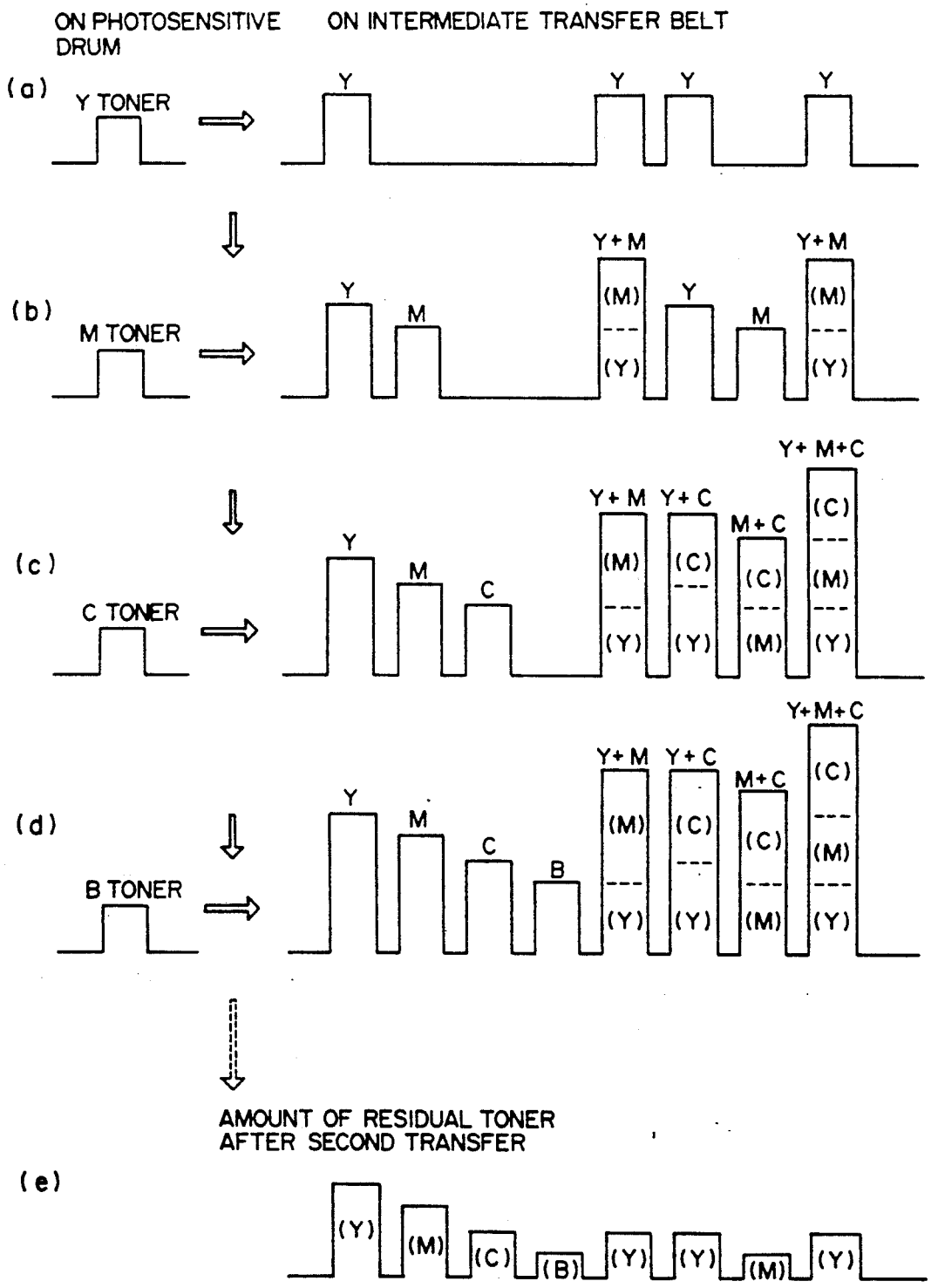
FIG. 5 is an explanatory view showing changes of charge on toner during a transferring process in a comparative case.
Figure 6:
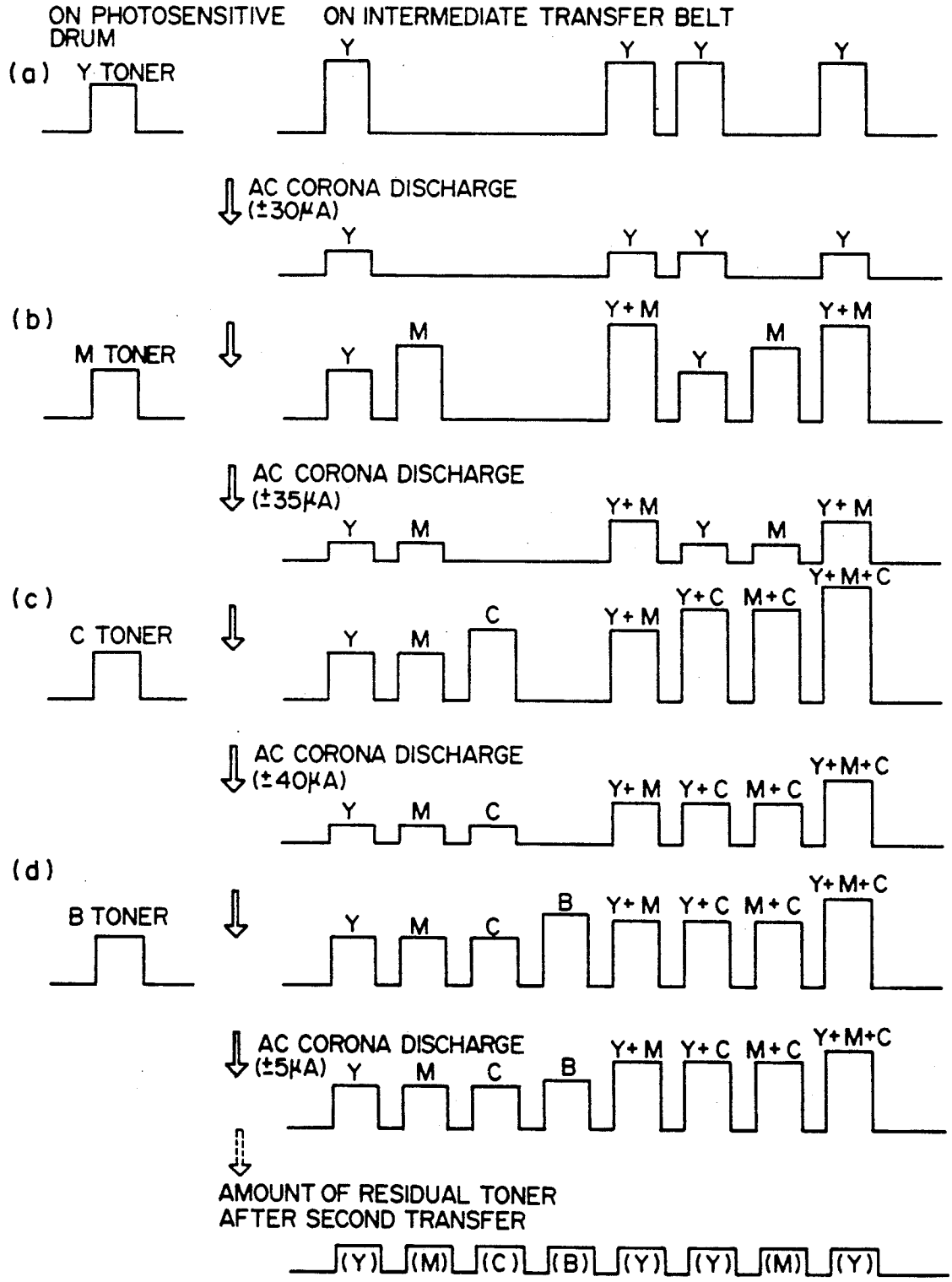
FIG. 6 is an explanatory view showing changes of charge on toner during a transferring process according to the first embodiment.

The effect of the AC corona discharge will be described by comparing a case of not applying AC corona discharge to the toner after the first transfer (FIG. 5) with a case of applying the AC corona discharge from the AC charger 16 to the toner (FIG. 6).

Referring to FIG. 5 which shows the case of not applying AC corona discharge to the toner after the first transfer, the amount of toner charge increases as the M toner, the C toner and the B toner are being overlaid on the Y toner, and finally after the first transfer of the B toner, the charge on the toner layers is considerably high. If the second transfer is performed in this condition, the transfer efficiency is low, and a lot of toner is left on the intermediate transfer belt 5 as shown by (e). This causes many white spots on the copy image, and also the cleaning device 15 must remove a lot of residual toner.

FIG. 6 shows the amount of toner charge on the intermediate transfer belt 5 in the case of applying AC corona discharge to the toner in a manner according to the first embodiment, that is, by heightening the output of the AC charger 16 gradually from the voltage Vl, the voltage V2 and to the voltage V3 and lowering the output of the AC charger 16 to the voltage V0 immediately before the second transfer. As described above, the output of the AC charger 16 is controlled so that the current flowing in the electrode roller 10 will be ±30 μA, ±35 μA, ±40 μA and ±5 μA after the first transfer of the Y toner, the M toner, the C toner and the B toner respectively. Thereby, the charge on the toners at the time of starting the second transfer, as shown by (d), is fairly low compared with FIG. 5 (*d*) and appropriate for the second transfer. Consequently in this case the second transfer efficiency is high, and only little toner is left on the intermediate transfer belt 5.

Figure 7:
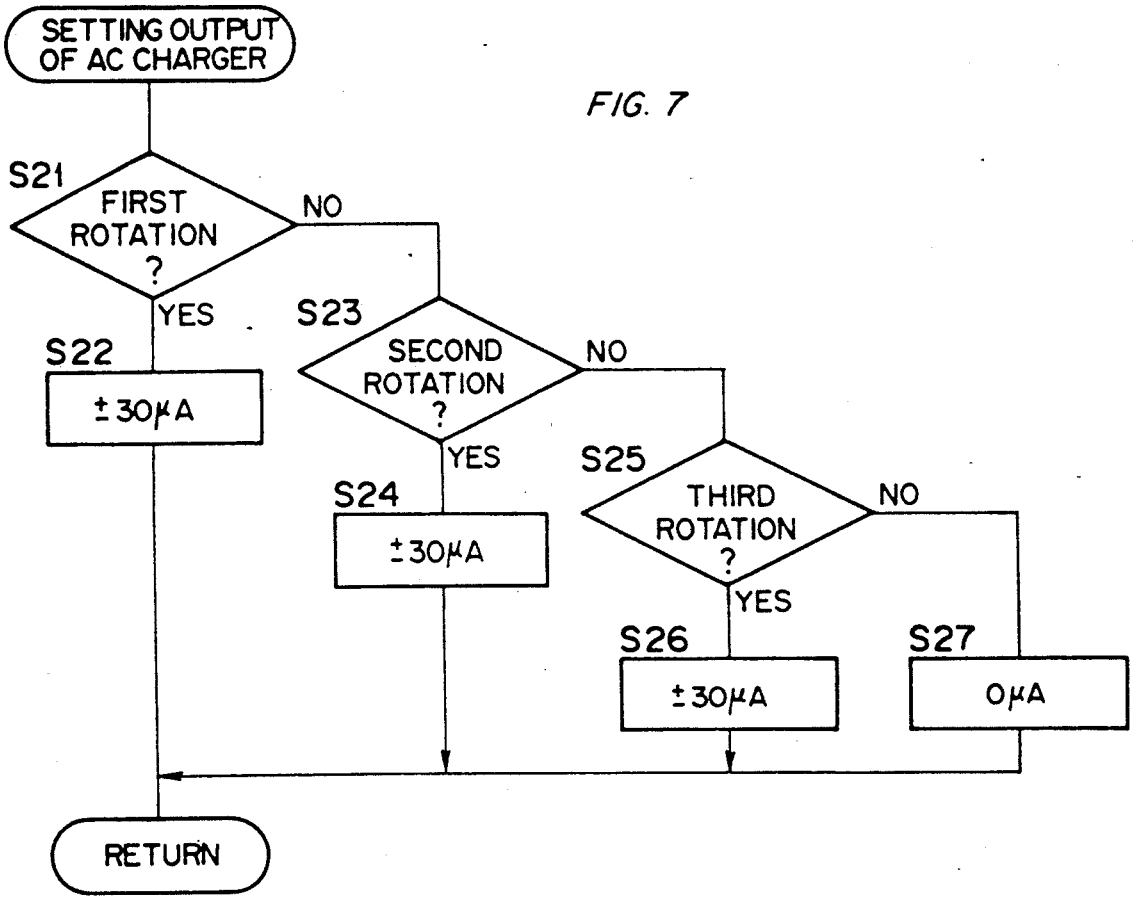
FIG. 7 is a flowchart showing a control procedure of an image forming apparatus of a second embodiment according to the present invention.
Figure 8:
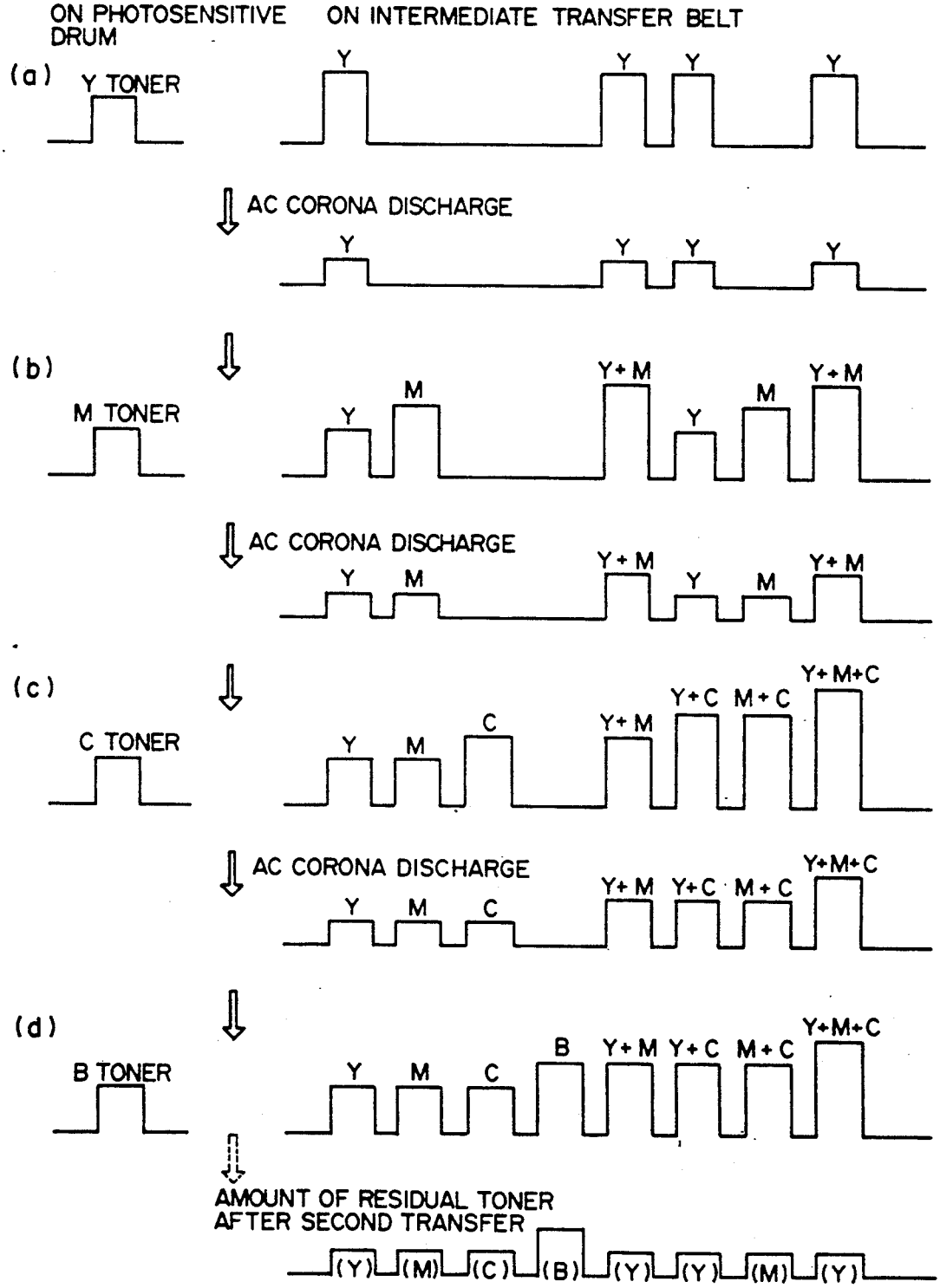
FIG. 8 is an explanatory view showing changes of charge on toner during a transferring process according to the second embodiment.
Figure 9:
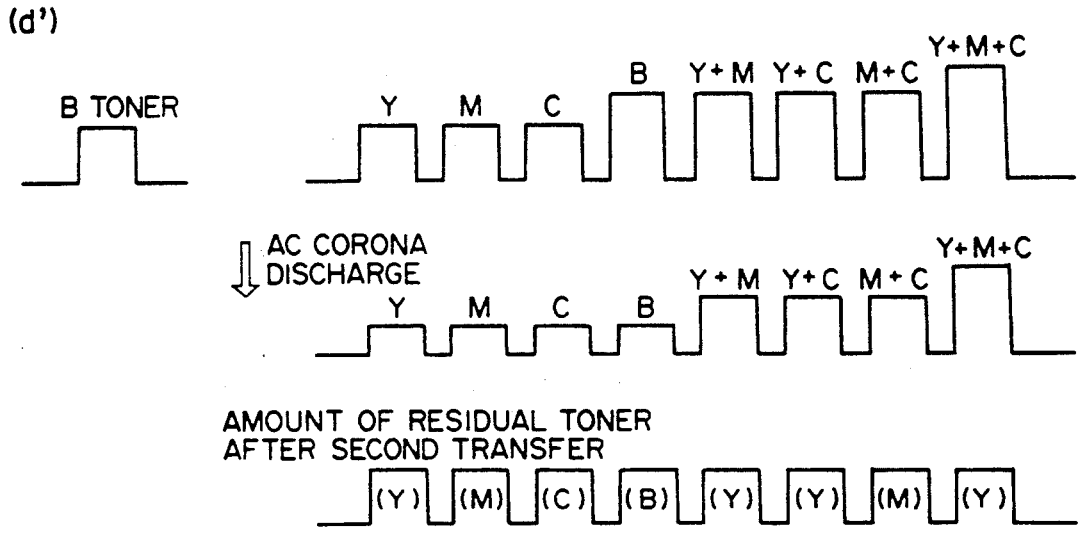
FIG. 9 is an explanatory view showing changes of charge on toner during a transferring process in a comparative case.

Second Embodiment: FIGS. 7-9

A second embodiment of the present invention is hereinafter described. In the second embodiment, the same image forming apparatus and control circuitry as shown in FIGS. 1 and 3 are used. A distinctive point of the second embodiment is setting of output of the AC charger 16 in the full color copy mode.

In the second embodiment, while the Y toner image, the M toner image and the C toner image are transferred to the intermediate transfer belt 5 one by one, the AC charger 16 is kept impressed with the voltage Vl in order t reduce toner charge increased by the discharge from the first transfer charger 6. Then, after the first transfer of the B toner image and before the second transfer, the AC charger 16 is turned off, and in this state the second transfer is performed.

The output of the AC charger 16 is controlled following a procedure represented by the flowchart of FIG. 7. The number of rotations of the intermediate transfer belt 5 is detected at steps S21, S23 and S25, and the output of the AC charger 16 is set at step S22, S24, S26 or S27 according to the number of rotations. When it is judged that the intermediate transfer belt 5 has started a first, a second or a third rotation ("YES" at step S21, S23 or S25), the output of the AC charger 16 is set at step S22, S24 or S26 so as to cause an electric current of ±30 μA to flow in the electrode roller 10. When the judgment at step S25 is "NO", which means that the intermediate transfer belt 5 has started a fourth rotation, the output of the AC charger 16 is set at step S27 so as not to cause an electric current flow in the electrode roller 10, that is, the AC charger 16 is turned off.

FIG. 8 shows adjustment of toner charge on the intermediate transfer belt 5 in the second embodiment. The intermediate transfer belt 5 is subjected to a fixed amount of AC corona discharge from the AC charger 16 every after the first transfer of the Y toner, the M toner and the C toner, and therefore charge on the toners is kept low compared with the comparative case shown in FIG. 5. Toner charge on the intermediate transfer belt 5 immediately after the first transfer of the B toner is shown by FIG. 8 (*d*). According to the second embodiment, the second transfer is performed in this state without further applying the AC corona discharge to the toners. Charge on the B toner which was not exposed to the AC corona discharge is a little higher than that on the other toners. Accordingly regarding the B toner, the second transfer efficiency is slightly low, and more toner is left on the intermediate transfer belt 5. However, the other toners can be transferred onto a copy sheet S evenly and with high transfer efficiency. Further, the transfer efficiency of the B toner is not so low that the B toner on the copy sheet S will look thin. Thus, not exposing the B toner to the AC discharge causes no practical problems.

On the contrary, if the AC charger 16 further outputs the same amount of AC corona discharge after transfer of the B toner to the intermediate transfer belt 5, charge on the toner layers will become too low to keep fine transfer efficiency. This causes problems that the density of the copy image is low and that a lot of toner is left on the intermediate transfer belt 5.

Third Embodiment: FIGS. 10-14

Figure 10:
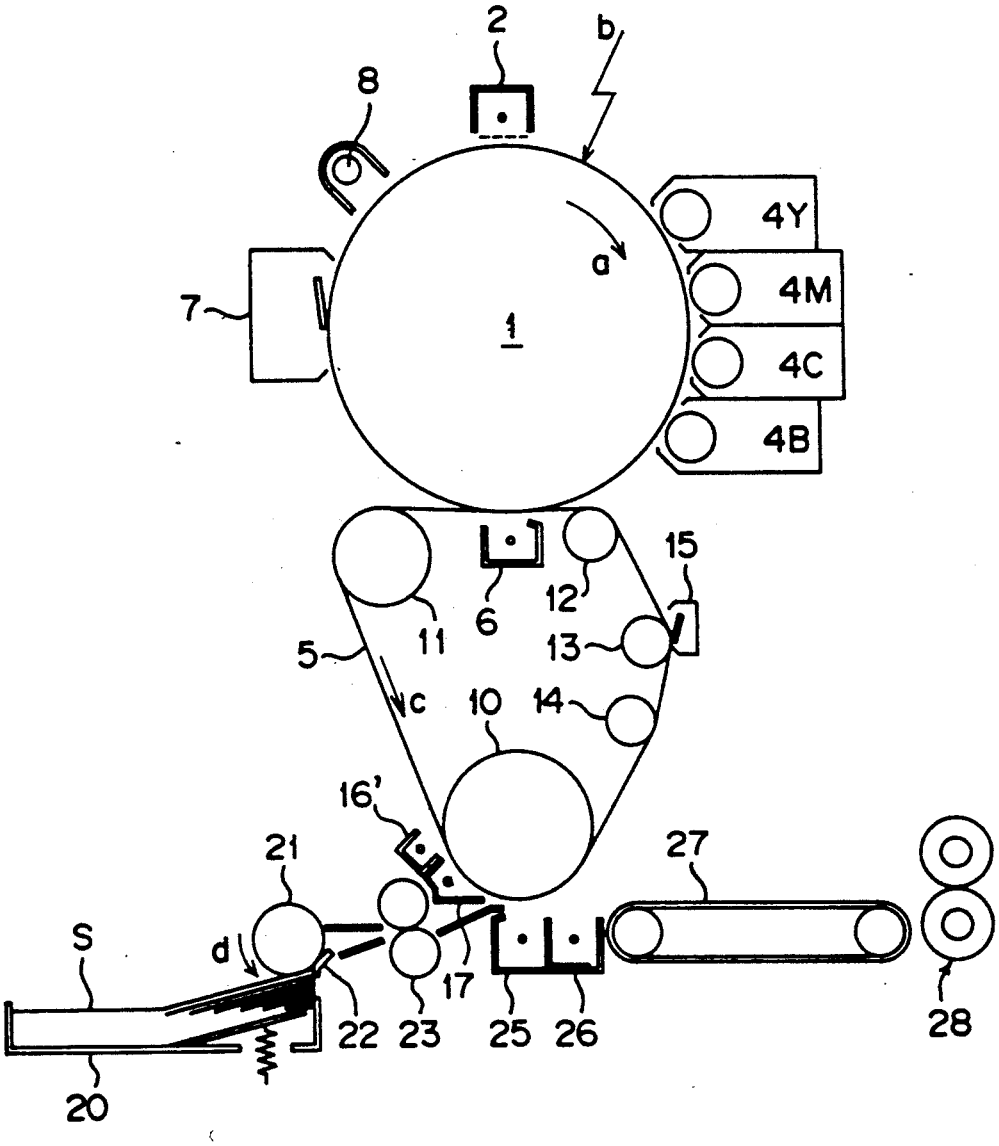
FIG. 10 is a schematic elevational view of an image forming apparatus of a third embodiment according to the present invention.

FIG. 10 shows a full color copying apparatus of a third embodiment. This apparatus comprises the same type of image forming elements as the apparatus of the first embodiment illustrated in FIG. 1, and the image formation process is basically the same as the apparatus of the first embodiment. In FIG. 10, the same elements are referenced by the same numbers as in FIG. 1, and the description of these elements is omitted.

In the third embodiment, an AC charger 16' and a DC charger 17 are disposed in an upstream side of the second transfer charger 25, and they face the intermediate transfer belt 5. The AC charger 16', whose charging wire is impressed with an alternating current of 5kV, applies AC corona discharge to toner images on the intermediate transfer belt 5. The DC charger 17 is to apply DC corona discharge to the toner images on the intermediate transfer belt 5, the DC corona discharge having the same polarity as that of the toner. In order to do that, a direct current of 5kV is impressed on a charging wire of the DC charger 17.

Figure 11:
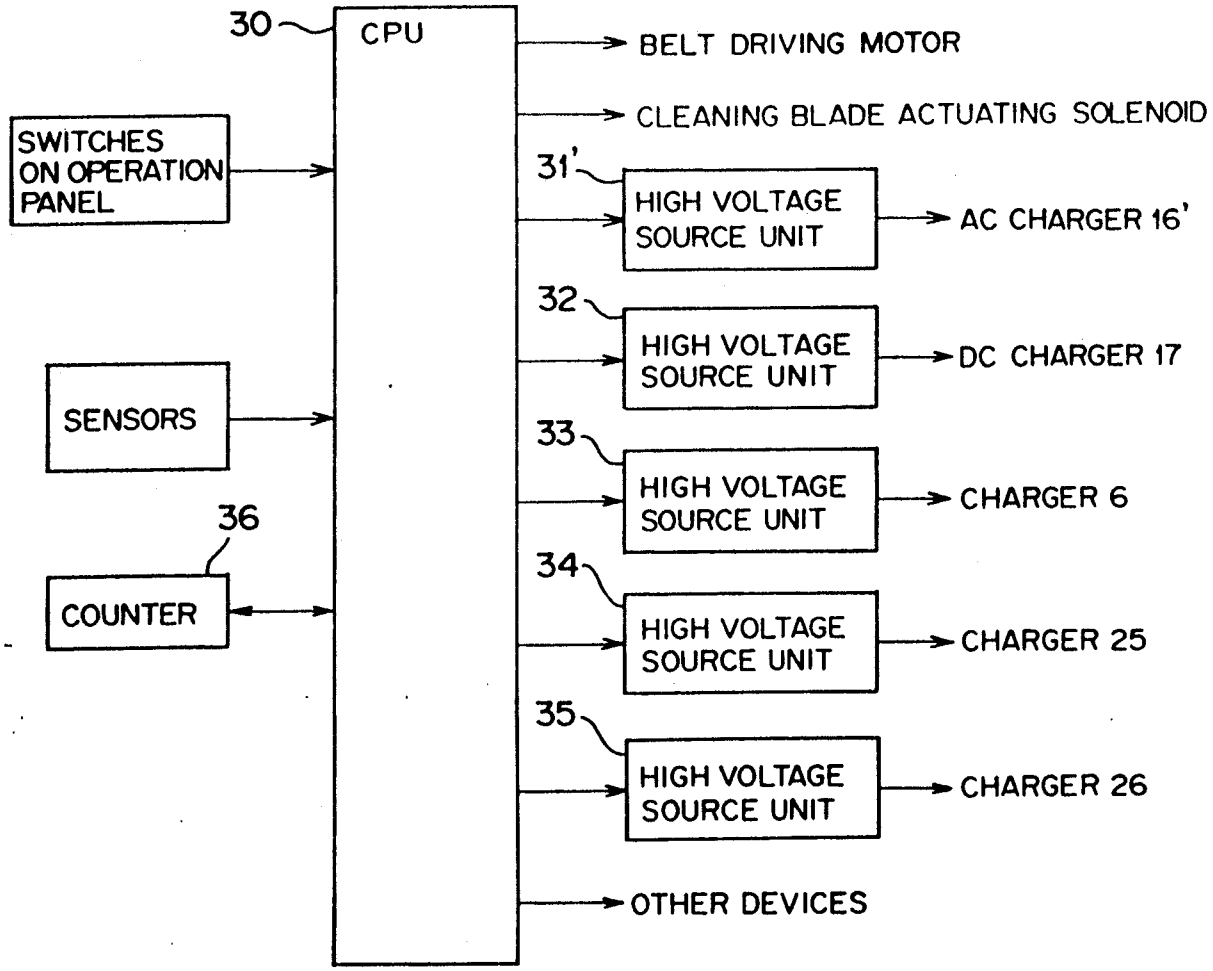
FIG. 11 is a block diagram showing a control circuitry of the image forming apparatus of the third embodiment

Referring to FIG. 11 showing a control circuitry of the apparatus, high voltage source units 31' and 32 of the chargers 16' and 17 are controlled by the CPU 30. The composition of the control circuitry is the same as that of the first embodiment illustrated in FIG. 3.

In this apparatus, in the full color copy mode, the toner images transferred to the intermediate transfer belt 5 are exposed to AC corona discharge and DC corona discharge when they are passing the AC charger 16' and the DC charger 17 respectively. Thereby, the amount of toner charge is adjusted.

Adjustment of toner charge achieved by the corona discharge from the AC charger 16' and the DC charger 17 is hereinafter described.

In order to clarify the effect of the AC corona discharge and the DC corona discharge, the following three cases are compared: a case of not applying any discharge to the toner after the first transfer, a case of applying only AC corona discharge to the toner, and a case of applying both the AC corona discharge and the DC corona discharge to the toner in a manner according to the third embodiment.

FIG. 12 shows the case of not applying any discharge to the toner after the first transfer.

First, a toner Ta deposited on the photosensitive drum 1 is transferred to the intermediate transfer belt 5 by DC negative corona discharge from the first charger 6. During the transfer, the toner Ta obtains a little more charge (see FIG. 12 (*b*) and (*c*)). The toner Ta is partly left on the photosensitive drum 1. and the residual toner Ta' is removed by the cleaning device 7. Next, a toner Tb of another color is transferred to the intermediate transfer belt 5, and during the transfer of the toner Tb, the toner Ta on the belt 5 further obtains more charge (see FIG. 12 (*e*) and (*f*)). Then, the toners Ta and Tb are transferred to a copy sheet S by DC negative corona discharge from the second transfer charger 25 (see FIG. 12 (*g*)). The transfer quality of the toners Ta and Tb is inversely proportionate to the amount of charge on the toners Ta and Tb. In this case, therefore, the transfer quality as a whole is low, and the amount of residual toners Ta'' and Tb'' on the belt 5 is large. Moreover, the transfer quality is different between the toners Ta and Tb by an amount D, which results in uneven color density. Also white spots appear on the copy image within the area of the toner Ta.

FIG. 13 shows the case of applying only AC corona discharge to the toner after the first transfer.

In this case, the AC corona discharge from the AC charger 16' is applied to the toner Ta transferred to the intermediate transfer belt 5. Thereby, superficial part of the toner Ta is reversely charged (see FIG. 13 (c)). Then, when the toner Tb of another color is transferred to the intermediate transfer belt 5, the reversely charged part of the toner Ta is transferred back to the photosensitive drum 1. Thus the amount of the toner Ta on the intermediate transfer belt 5 is decreased, and the amount of charge on the toner Ta becomes back to the state immediately after the first transfer of the toner Ta. The AC charger 16' further applies the AC corona discharge to the toners Ta and Tb, whereby superficial part of the toners Ta and Tb is reversely charged (see FIG. 13 (*f*)). In this state the toners Ta and Tb are transferred to a copy sheet S by the DC corona discharge from the second transfer charger 25. In this case the transfer efficiency is high, and image noise such as white spots on the copy image is inhibited (see FIG. 13 (*g*)). However, since the toner Ta was partly transferred back to the photosensitive drum 1 (see FIG. 13 (e)), there is still a transfer quality different D between the toner Ta and Tb, which results in uneven color density.

FIG. 14 shows the case of applying both AC corona discharge and DC corona discharge to the toner after the first transfer in a manner according to the third embodiment.

The toner Ta transferred to the intermediate transfer belt 5 is exposed to the AC corona discharge from the AC charger 16', and superficial part of the toner Ta is reversely charged. Then, when the toner Ta is exposed to DC corona discharge having the same polarity as the toner Ta from the DC charger 17, the reverse charge on the superficial part of the toner Ta is erased (see FIG. 14 (*d*)). Thereby, when the toner Tb of another color is transferred to the belt 5, the toner Ta is never transferred back to the photosensitive drum 1 (see FIG. 14 (*f*)). Then, the toners Ta and Tb on the belt 5 are further exposed to the AC corona discharge and the D corona discharge, such that charge on the toners Ta and Tb is adjusted (see FIG. 14 (*g*) and (*h*)). The amount of charge on the toner Ta and the amount of charge on the toner Tb after the DC corona discharge are equal to each other, and the amounts are equal to the amount of charge on the toner Ta when it was on the photosensitive drum 1 shown by FIG. 14 (*a*). In this state the toners Ta and Tb are transferred to a copy sheet S. The transfer efficiency is fine, and there is no difference between the amount of the toner Ta transferred and the amount of the toner Tb transferred (see FIG. 14 (*i*)), whereby uneven color density never appears on the copy image. During the first transfer of the toner Tb, the toner Ta is never transferred back to the photosensitive drum 1. Therefore, little toner is left on the photosensitive drum 1 and on the intermediate transfer belt 5. Thus the image reproduction in this method produces little residual toner.

Image reproduction using toners of two colors has been described referring to FIGS. 12, 13 and 14, but in the full color copy mode, toners of four colors are used, that is, the first transfer is repeated four times to copy a single full color image.

Although the present invention has been described in connection with the preferred embodiments above, it is to be noted that various changes and modifications are apparent to a person skilled in the art. Such changes and modifications are to be understood as being within the scope of the present invention defined by the appended claims.

The present invention may be adapted to form an image using toners of two or three colors as well as used to form an image in the full color copy mode using toners of four colors.

Further, not only ordinary paper but also special paper such as OHP (overhead projector) sheets may be used as copy sheets in such apparatuses.

Furthermore, for the image exposure, not only an analog method using a visible ray but also a digital method using a laser beam may be adopted

What is claimed is:

1. An image forming apparatus comprising:

an electrostatic latent image carrying member which is rotated in one direction;

means for forming a toner image on the electrostatic latent image carrying member;

a transfer medium facing the electrostatic latent image carrying member, the transfer medium being rotated such that the facing part moves in the same direction as the electrostatic latent image carrying member;

first transfer means for transferring the toner image from the electrostatic latent image carrying member to the transfer medium;

means for reducing charge on the toner image transferred to the transfer medium, the charge reducing means being disposed in a downstream side of the first transfer means in respect to the direction of rotation of the transfer medium;

second transfer means for transferring the toner image on the transfer medium to a sheet, the second transfer means being disposed in a downstream side of the charge reducing means in respect to the direction of rotation of the transfer medium;

count means for detecting the number of toner images transferred from the electrostatic latent image carrying member to the transfer medium; and means for setting output of the charge reducing means in accordance with the number detected by the count means.

2. An image forming apparatus as claimed in claim 1, wherein the setting means sets the output of the charge reducing means to larger values as the number of toner images transferred to the transfer medium is increasing, and the setting means sets the output of the charge reducing means to a value smaller than the foregoing values after a last toner image is transferred to the transfer medium.

3. An image forming apparatus as claimed in claim 1, wherein the setting means sets the output of the charge reducing means to a specified value every after a toner image is transferred to the transfer medium except for a last toner image, and the setting means sets the output of the charge reducing means to 0 after the last toner image is transferred to the transfer medium.

4. An image forming apparatus as claimed in claim 1, wherein toner images of three primary colors and a black toner image are formed on the electrostatic latent image carrying member one by one in order, and the toner images are transferred to the transfer medium and overlaid thereon in the same order.

5. An image forming apparatus as claimed in claim 1, wherein the charge reducing means is an AC corona discharger for applying AC corona discharge to a toner image.

6. An image forming method wherein a toner image formed in an electrostatic latent image carrying member is transferred to a transfer medium and further transferred to a sheet, the method comprising:

a first step of forming a toner image on the electrostatic latent image carrying member;

a second step of transferring the toner image from the electrostatic latent image carrying member to the transfer medium;

a third step of reducing charge on the toner image transferred to the transfer medium;

a fourth step of forming a toner image on the electrostatic latent image carrying member;

a fifth step of transferring the toner image from the electrostatic latent image carrying member to the transfer medium resulting in a toner charge on said transfer medium; and a sixth step of transferring the toner images from the transfer medium to a sheet wherein the sixth step is initiated while the transfer medium substantially retains the toner charge.

7. An image forming method as claimed in claim 6, wherein the first, second and third steps are repeated a predetermined number of times.

8. An image forming method wherein a toner image formed on an electrostatic latent image carrying member is transferred to a transfer medium and further transferred to a sheet, the method comprising:

a first step of forming a toner image on the electrostatic latent image carrying member;

a second step of transferring the toner image from the electrostatic latent image carrying member to the transfer medium;

a third step of reducing charge on the toner image transferred to the transfer medium;

a fourth step of repeating the first, second and third steps a predetermined number of times;

a fifth step of forming a toner image on the electrostatic latent image carrying member;

a sixth step of transferring the toner image from the electrostatic latent image carrying member to the transfer medium;

a seventh step of reducing charge on the toner image transferred to the transfer medium, the amount of charge reduced in the seventh step being smaller than those in the third step; and an eighth step of transferring the toner images from the transfer medium to a sheet.

9. An image forming apparatus as claimed in claim 8, wherein the amount of toner charge reduced in the third step becomes larger each time the third step is repeated.

10. An image forming apparatus comprising:

an electrostatic latent image carrying member which is rotated in one direction;

means for forming a toner image on the electrostatic latent image carrying member;

a transfer medium facing the electrostatic latent image carrying member;

first transfer means for transferring the toner image from the electrostatic latent image carrying member to the transfer medium;

means for reducing charge on the toner image transferred to the transfer medium;

means for recharging the toner image which was processed by the charge reducing means; and second transfer means for transferring the toner image recharged by the recharging means to a sheet.

11. An image forming apparatus as claimed in claim 10, wherein toner images of three primary colors and black toner image are formed on the electrostatic latent image carrying member one by one in order, and the toner images are transferred to the transfer medium and overlaid thereon in the same order.

12. An image forming apparatus comprising:

an electrostatic latent image carrying member which is rotated in one direction;

means for forming a toner image on the electrostatic latent image carrying member;

a transfer medium facing the electrostatic latent image carrying member, the transfer medium being rotated such that the facing part moves in the same direction as the electrostatic latent image carrying member;

first transfer means for transferring the toner image from the electrostatic latent image carrying member to the transfer medium;

AC corona discharging means for applying AC corona discharge to the toner image transferred to the transfer medium, the AC corona discharging means being disposed in a downstream side of the first transfer means in respect to the direction of rotation of the transfer medium;

DC corona discharging means for applying DC corona discharge to the toner image transferred to the transfer medium, the DC corona discharge having the same polarity as the toner, the DC corona discharging means being disposed in a downstream side of the AC corona discharging means in respect to the direction of rotation of the transfer medium; and second transfer means for transferring the toner image on the transfer medium to a sheet, the second transfer means being disposed in a downstream side of the DC corona discharging means.

13. An image forming apparatus as claimed in claim 12, wherein toner images of three primary colors and a black toner image are formed on the electrostatic latent image carrying member one by one in order, and the toner images are transferred to the transfer medium and overlaid thereon in the same order.

* * * * *